US006384358B1

(12) United States Patent
Hirose

(10) Patent No.: US 6,384,358 B1
(45) Date of Patent: May 7, 2002

(54) DIRECT CURRENT SWITCH CAPABLE OF TURNING ON SLOWLY AND OFF QUICKLY

(75) Inventor: Hiroyuki Hirose, Yokohama (JP)

(73) Assignee: Satori Electric Co., Ltd., Tokyo (JP)

( * ) Notice: Subject to any disclaimer, the term of this patent is extended or adjusted under 35 U.S.C. 154(b) by 0 days.

(21) Appl. No.: 09/715,088

(22) Filed: Nov. 20, 2000

(30) Foreign Application Priority Data

Nov. 26, 1999 (JP) ..... 11-336080

(51) Int. Cl.[7] ..... H01H 3/42

(52) U.S. Cl. ..... 200/533; 200/437; 200/6 BA; 200/329

(58) Field of Search ..... 200/437, 325, 200/DIG. 42, 329, 1 V, 1 R, 6 BA, 533

(56) References Cited

U.S. PATENT DOCUMENTS 3,316,370 A * 4/1967 Ardizzi ..... 200/67
4,767,899 A * 8/1988 Sorenson et al. ..... 200/144 R
5,293,507 A * 3/1994 Hayakawa ..... 200/244
5,597,989 A * 1/1997 Nishio ..... 200/6 R
5,794,764 A * 8/1998 Hirose et al. ..... 200/437
6,100,483 A * 8/2000 Horie et al. ..... 200/437

* cited by examiner

*Primary Examiner*—Lincoln Donovan
*Assistant Examiner*—Kyung S. Lee
(74) *Attorney, Agent, or Firm*—Rader, Fishman & Grauer, PLLC

(57) ABSTRACT

Disclosed is a direct current switch which comprises, in a housing, a slidable actuator, one stationary contact and one pseudo stationary contact both fixed to the housing, a seesaw-like plate having one movable contact and one pseudo movable contact fixed to its opposite ends, and a swingable pusher operatively connected to the actuator to apply a pushing force to the seesaw-like plate all the time. The seesaw-like plate is supported by a fulcrum support to be balanced in the middle. The seesaw-like plate has an engagement piece fixed thereto in the vicinity of the movable contact, and the actuator has a resilient catch-and-hold piece fixed thereto on the movable contact's side. While the actuator is on the way to the end, the resilient catch-and-hold piece can catch and hold the engagement piece until the pusher makes the seesaw-like plate to be inclined toward the stationary contact, making the resilient catch-and-hold piece forcedly release the engagement piece, allowing the movable contact to quickly abut on the stationary contact.

8 Claims, 6 Drawing Sheets

DIRECT CURRENT SWITCH CAPABLE OF TURNING ON SLOWLY AND OFF QUICKLY

BACKGROUND OF THE INVENTION

1. Field of the Invention

The present invention relates to a small-sized direct current switch which is appropriate for use in a portable electric drill or any other electric-powered tool, and particularly to such a small-sized direct current switch which requires the quick turning-off and slow turning-on.

2. Related Arts

If an electric-powered tool is loaded heavily, and if its direct current switch turns off slowly, the electric arc will appear an elongated length of time between the stationary and movable contacts of the circuit, thus causing the contacts to be melted in short time.

It is liable that the movable and stationary contacts are melted together as a whole, thus allowing the drill or cutter to continue to rotate in dangerous condition. To prevent such danger, it is necessary that the switch be made to turn off quickly, thereby suppressing the appearance of arc between the movable and stationary contacts.

If the switch is so designed that the movable contact may leave the stationary contact quickly in the instant of switching off, the movable contact will be driven toward the stationary contact at such an increased speed that the so accelerated movable contact may bounce repeatedly on the stationary contact in the instant of switching on. This will cause electric arcs to appear an elongated length of time between the movable and stationary contacts, thus expediting the wear and deformation of the movable and stationary contacts.

In an attempt to obviate such problem, it has been proposed that dielectric current switches be designed so as to be capable of switching off quickly and switching on slowly, so that the life of the switch may extend.

Referring to FIG. 12, in such a conventional seesaw type of dielectric current switch a common pointed terminal 1 has its ridge 1*a* as a fulcrum for supporting the seesaw-like plate 3, which has movable contacts 3*a* and 3*b* formed on its opposite ends. An actuator 4 has a pusher 5 spring-biased toward the ridge of fulcrum 1*a*. The pusher 5 is pushed against the seesaw-like plate 3, still allowing the actuator 4 to move the pusher 5 back and forth on the seesaw-like plate 3. Two stationary contacts 2*a* and 2*b* are formed in confronting relation with the movable contacts 3*a* and 3*b*. One of the stationary contacts requires no anti-bounce means, and is hereinafter referred to as "pseudo" stationary contact 2*b*. Likewise, the counter movable contact is referred to as "pseudo" movable contact 3*b*. The actuator 4 has anti-bounce projection 6 formed on the side of the pseudo stationary and movable contacts 2*b* and 3*b*. The anti-bounce projection 6 permits the movable contact 3*a* to move toward the stationary contact 2*a* at a reduced speed.

Assume that the actuator 4 is moved back and forth, allowing the pusher 5 to move back and forth on the seesaw-like plate 3. When the pusher 5 stands upright on the ridge of fulcrum 1*a* of the common terminal 1, the seesaw-like plate 3 is balanced in the middle, and when the pusher 5 is on either side of the ridge of fulcrum 1*a,* the seesaw-like plate 3 is tilted accordingly so that the movable contact on the descending end may be put in contact with the counter stationary contact.

Assume that the pusher 5 traverses the ridge of fulcrum 1*a* from the left to right side, and that the seesaw-like plate 3 turns clockwise. Then, the seesaw-like plate 3 abuts on the anti-bounce projection 6 of the actuator 4 to retard its quick turn. Specifically in spite of traversing the ridge of fulcrum 1*a* of the common terminal 1 the pusher 4 cannot continue to turn the seesaw-like plate 3 still more.

The manual drive of the actuator 4 subsequent to abutment of the anti-bounce projection 6 against the seesaw-like plate 3 will displace the anti-bounce projection 6 rightward, so that the anti-bounce projection 6 may leave apart from the seesaw-like plate 3. After the distance between the movable and stationary contacts 3*a* and 2*a* has been shortened, the movable contact 3*a* is driven and put on the stationary contact by the pusher 5 alone, requiring no manual push any more. Thus, the bounce can be eliminated.

Conversely assume that the pusher 5 traverses the ridge of fulcrum 1*a* from the right to left side, starting from the right end at which the movable contact 3*a* stays on the stationary contact 2*a,* and that the seesaw-like plate 3 starts turning counter-clockwise. Just prior to the pusher's traversing the ridge of fulcrum 1*a* the anti-bounce projection 6 abuts on the seesaw-like plate 3. Thereafter, the force of the anti-bounce projection 6 to push down and turn the seesaw-like plate 3 counterclockwise about the ridge of fulcrum 1*a* increases so that it may be stronger than the pushing force of the pusher, thus forcedly departing the movable contact 3*a* from the stationary contact 2*a* even though they are melted and stacked together. After the pusher 5 traverses the ridge of fulcrum 1*a,* the movable contact 3*a* may be put apart from the stationary contact 2*a* by the pusher 5 alone.

FIG. 13 shows another conventional fast switching-off type of direct current switch. As shown in the drawing, a common terminal 9 has its pointed end 9*a* as a fulcrum for supporting the seesaw-like plate 8, which has movable contacts 8*a* and 8*b* formed on its opposite ends. An actuator 11 has a pusher 12 loosely fitted in its recess. The pusher 12 is pushed downward with a spring 10 in the recess of the actuator 11 so that it may be raised and lowered in the recess, still remaining on the seesaw-like plate 8 while the actuator 11 moves horizontally. Thus, the seesaw-like plate 8 is allowed to turn clockwise or counter clockwise about its fulcrum. The seesaw-like plate 8 has a plateau 13 lying from the fulcrum 9*a* toward the right movable contact 8*a*.

When the actuator 11 is pushed rightward by hand, the pusher 12 is moved rightward on the seesaw-like plate 8, and it climes the plateau 13, continuing to move rightward while turning the seesaw-like plate 8 clockwise about its pointed fulcrum 9*a*. Finally the movable contact 8*a* abuts on the stationary contact 7*a,* making an electric connection between the common terminal 9 and the stationary contact 7*a*.

The climbing-up of the plateau 13 effectively retards the abutment of the movable contact 8*a* on the stationary contact 7*a,* thus attaining the slow switching-on of the seesaw type of switch.

Conversely when the actuator 11 is pushed leftward, the pusher 12 slides down quickly from the plateau 13 when traversing the fulcrum point 9*a,* thus allowing the seesaw-like plate 8 to turn counter-clockwise about the fulcrum point 9*a*. Then, the spring 10 is allowed to extend the stepwise-distance or flight of the plateau 13 from the compressed condition in which the coil 10 was compressed by the pusher 12 remaining on the plateau 13. The sliding-own of the pusher 12 is expedited by the releasing of the spring 12 to give a quick push to the seesaw-like plate 8, thus attaining the quick switching-off of the seesaw-like switch.

As for the seesaw-like switch of FIG. 12, the switching-on can be satisfactorily retarded by the anti-bounce projection 6. The beginning of the switching-off, however, depends on the manual movement of the anti-bounce projection 6, and therefore, the switching-off is retarded, and is slower than that performed by the automatic seesaw action.

As for the seesaw-like switch of FIG. 13, disadvantageously the slowness in the retarded switching-on and the quickness in the expedited switching-off depend on the speed at which the actuator 11 is moved, and the bounce cannot be effectively prevented.

SUMMARY OF THE INVENTION

One object of the present invention is to provide a direct current seesaw type of switch which is capable of effectively expediting the switching-off and retarding the switching-on of the switch.

To attain this object, a direct current switch comprises an insulating housing, an actuator slidably fixed to the housing, a support fixed to the housing, one stationary contact and one pseudo stationary contact both fixed to the housing, the stationary and pseudo stationary contacts being arranged symmetrically with respect to the support, a seesaw-like plate having one movable contact and one pseudo movable contact fixed to its opposite ends, the seesaw-like plate being supported by the support to be balanced in the middle, and a swingable pusher operatively connected to the actuator to apply a pushing force to the seesaw-like plate all the time, is improved according to the present invention in that the seesaw-like plate has an engagement piece fixed thereto in the vicinity of the movable contact, and that the actuator has a resilient catch-and-hold piece fixed thereto on the movable contact's side, whereby while the actuator is on the way to the end, the resilient catch-and-hold piece may catch and hold the engagement piece until the pusher makes the seesaw-like plate to be inclined toward the stationary contact, making the resilient catch-and-hold piece forcedly release the engagement piece, allowing the movable contact to quickly abut on the stationary contact.

The movable contact may be allowed to move toward the stationary contact after the swingable pusher traverses the support.

The engagement piece may comprise an inverted "L"-shaped piece whose upright leg is bent so as to be caught by the catch-and-hold piece.

The catch-and-hold piece may be of a spring plate.

The catch-and-hold piece may comprise an inverted "U"-shaped piece to pinch the engagement piece.

The catch-and-hold piece may be so shaped that it may push the engagement piece on one side.

The catch-and-hold piece may comprise an inverted "U"-shaped piece, and the engagement piece comprises a "U"-shaped piece, which is sized so as to be snugly fitted in the inverted "U"-shaped piece.

The seesaw-like plate may have a ramp formed in the vicinity of the fulcrum at which the support bears the seesaw-like plate, and the pusher and the actuator may be so loosely connected that the pusher may be allowed to swing while pushing the seesaw-like plate.

Other objects and advantages of the present invention will be understood from the following description of seesaw type of switches according to preferred embodiments of the present invention, which are shown in accompanying drawings.

DETAILED DESCRIPTION OF PREFERRED EMBODIMENT

Figure 1A:
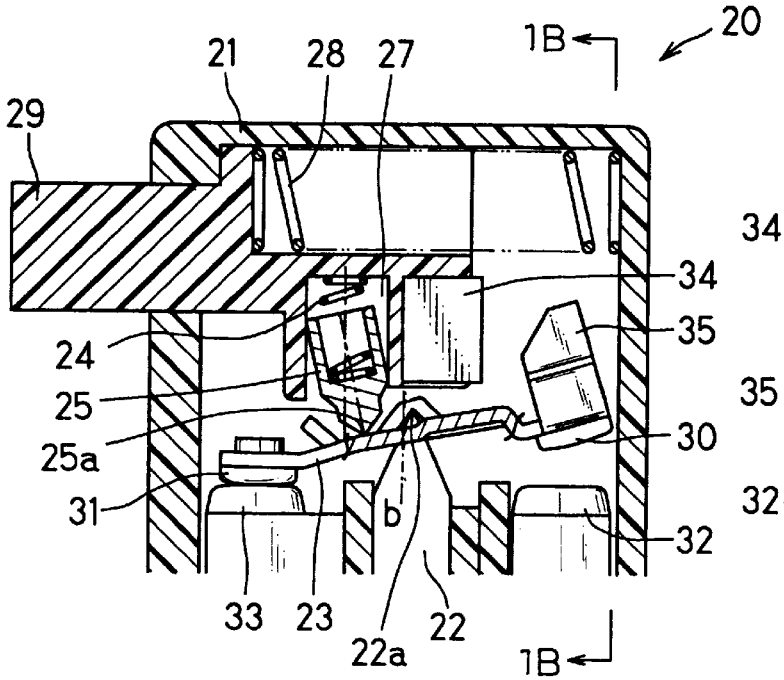
FIG. 1A is a longitudinal section of a seesaw type of switch according to a first embodiment.
Figure 1B:
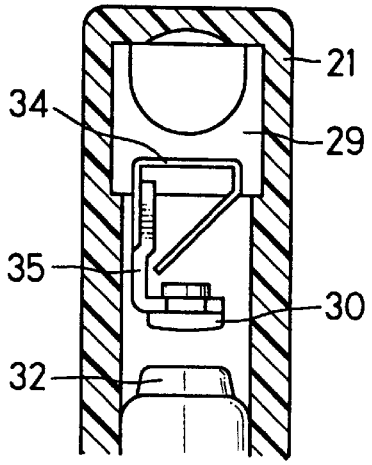
FIG. 1B is another longitudinal section taken along the line 1B—1B in FIG. 1A.
Figure 2:
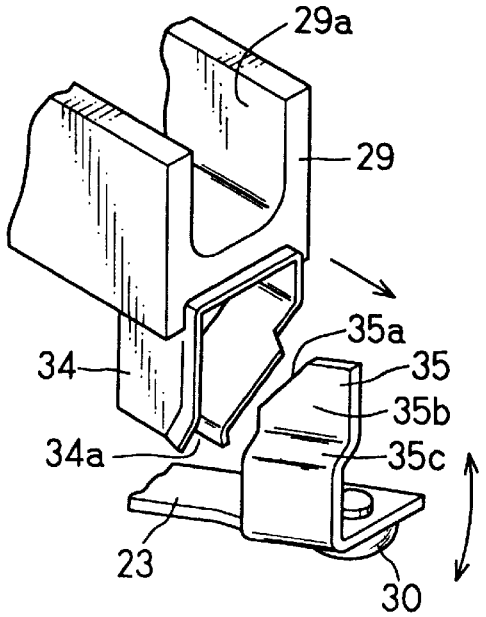
FIG. 2 is a perspective view of the anti-bounce mechanism of the switch.
Figure 3:
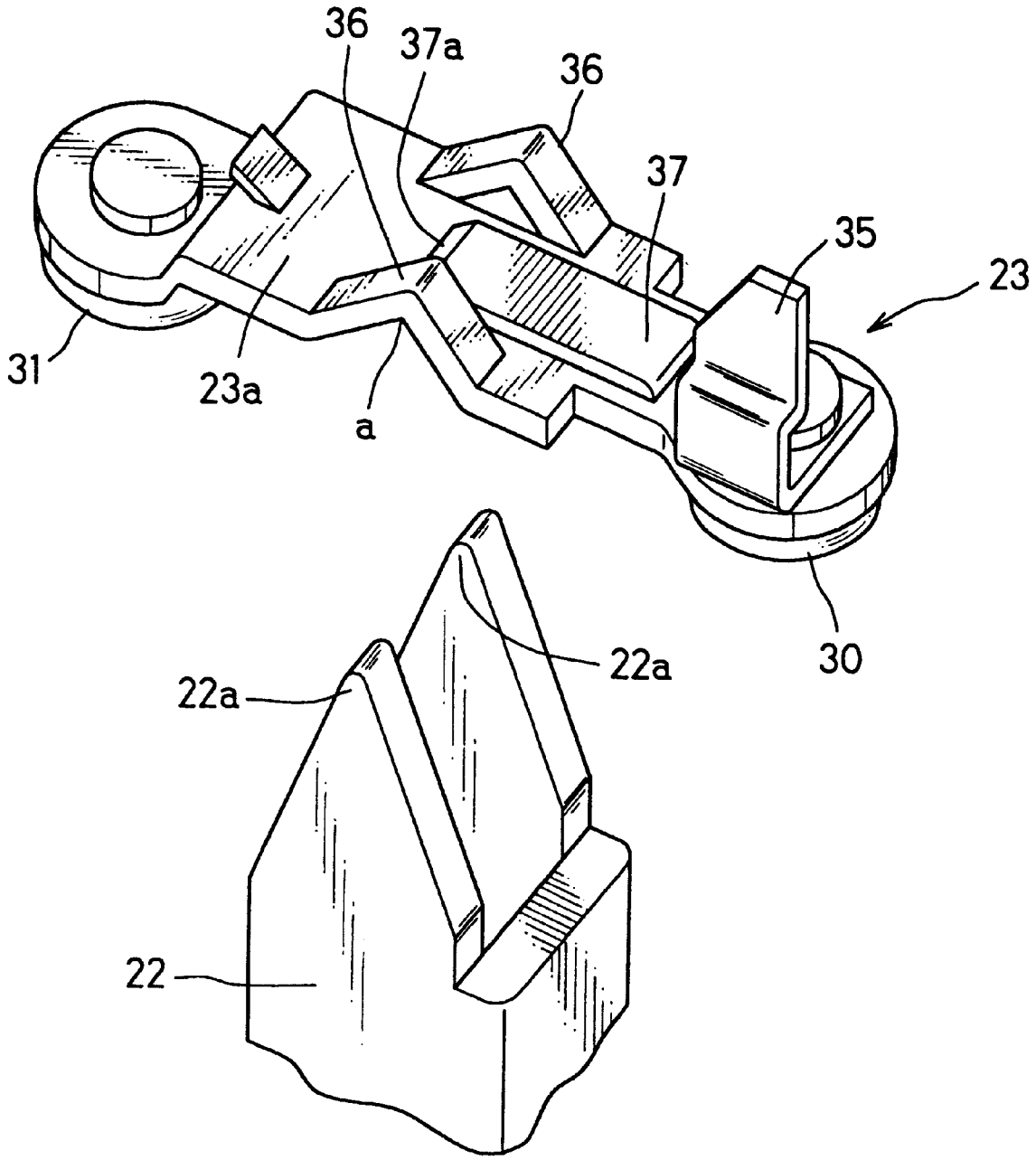
FIG. 3 is a perspective view of the seesaw-like plate and the tapered support.

FIGS. 1 to 3 show a seesaw type of direct current switch 20 according to the first embodiment of the present invention. As shown in these drawings, it comprises, in an insulating housing 21, a common terminal 22 functioning as a fulcrum support, a seesaw-like plate 23 supported by the tapering end 22*a* of the common terminal 22 to be balanced in the middle, and an actuator 29 slidably fixed to the insulating housing 21. The actuator 29 is spring-biased outward by a coiled spring 28, so that it may project partly from the insulating housing 21. The actuator 29 can be depressed in the housing 21 to move forward in the insulating housing 21. The actuator 29 has a spring-biased pusher 25 loosely fitted in its recess. Specifically the pusher 25 is a hollow body having a tapering end 25*a*, and it is loosely fitted in the cylindrical space 27 of the actuator 29. The pusher 25 is pushed against the seesaw-like plate 23 by a coiled spring 24, which is fitted partly in the hollow space of the pusher 25 and partly in the cylindrical space 27 of the actuator 29. The seesaw-like plate 23 is supported by the tapering end 22*a* of the support 22, which functions as the fulcrum. As the actuator 29 moves back and forth, the pusher 25 swings accordingly, allowing its tapering end 25*a* to slide on the seesaw-like plate 23. The seesaw-like plate 23 has one movable contact 30 and one pseudo movable contact 31 fixed to its opposite ends, and one stationary contact 32 and one pseudo stationary contact 33 are arranged symmetrically with respect to the support 22. These stationary contact 32 and pseudo stationary contact 33 are fixed to the housing 21 in confronting relation with the movable contact 30 and pseudo movable contact 31. The actuator 29 has a resilient catch-and-hold piece 34 fixed thereto on the movable contacts side. The seesaw-like plate 23 has an engagement piece 35 fixed thereto in the vicinity of the movable contact 30.

With the arrangement as described above, depression of the actuator 29 makes the swingable pusher 25 slide forward on the seesaw-like plate 23 so that the seesaw-like plate 23 may turn clockwise, thereby putting the movable contact 30 on the stationary contact 32. Release of the actuator 29 allows the swingable pusher 25 to slide backward on the seesaw-like plate 23 so that the seesaw-like plate 23 may turn counter clockwise, allowing the movable contact 30 to leave the stationary contact 32. The movable contact 30 is kept apart from the stationary contact 32 while the pseudo movable contact 31 is put on the pseudo stationary contact 33; these pseudo movable and stationary contacts function as braking means.

As seen from FIG. 2, the actuator 29 has a trough-like extension from its shank, and the coiled spring 28 is contained in the "U"-shaped space 29*a* of the trough-like extension. The catch-and-hold piece is composed of an inverted "U"-shaped spring plate 34, which is fixed to the bottom of the trough-like extension. As shown, it converges downward to define a throat 34*a*.

The engagement piece 35 is an "L"-shaped piece integrally connected to the seesaw-like piece 23 at the rear side of the movable contact 23. As shown, the "L"-shaped piece is composed of an upright section from one edge of the horizontal leg, an inward-bent section 35*c* consecutive to the upright section, and another upright section 35*b* consecutive to the inward-bent section 35*c*. The second upright section is chamfered at one comer as indicated at 35*a*.

The second upright section 35*b* of the engagement piece 35 can be inserted in the throat 34*a* of the catch-and-hold piece 34 to be pinched and held therebetween.

As seen from FIG. 3, the seesaw-like plate 23 has triangular bearings 36 formed in the middle, thus defining the fulcrum points "a" at which the seesaw-like plate 23 may be supported to be balanced in the middle. When the tapering end 25*a* of the pusher 25 is aligned vertically with the opposite fulcrum points "a", the seesaw-like plate 23 is balanced in the middle with the fulcrum points "a" above the flat plane 23*a* of the seesaw-like plate 23.

As seen from FIG. 3, a ramp-and-plateau 37*a* and 37 is formed on the flat plane 23*a* of the seesaw-like plate 23. The ramp-and-plateau 37*a* and 37 extends from the middle of the seesaw-like piece 23 toward the "L"-shaped engagement piece 35 with the ramp 37*a* traversing the vertical plane "b" containing the opposite fulcrum points "a".

Figure 4A:
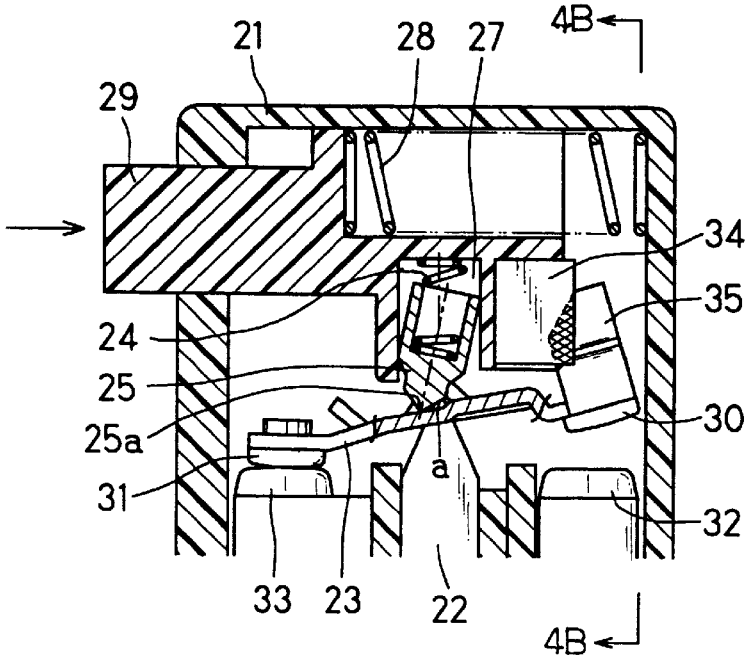
FIG. 4A is a longitudinal section of the switch.
Figure 4B:
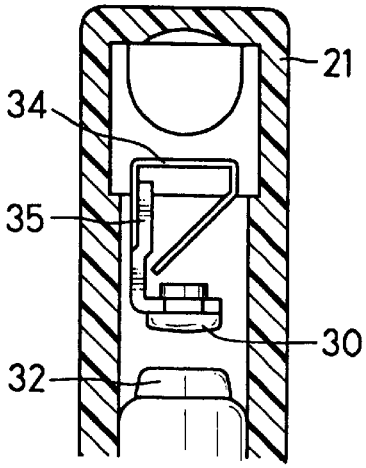
FIG. 4B is another longitudinal section taken along the line 4B—4B in FIG. 4A, illustrating how it works at the first step.
Figure 5A:
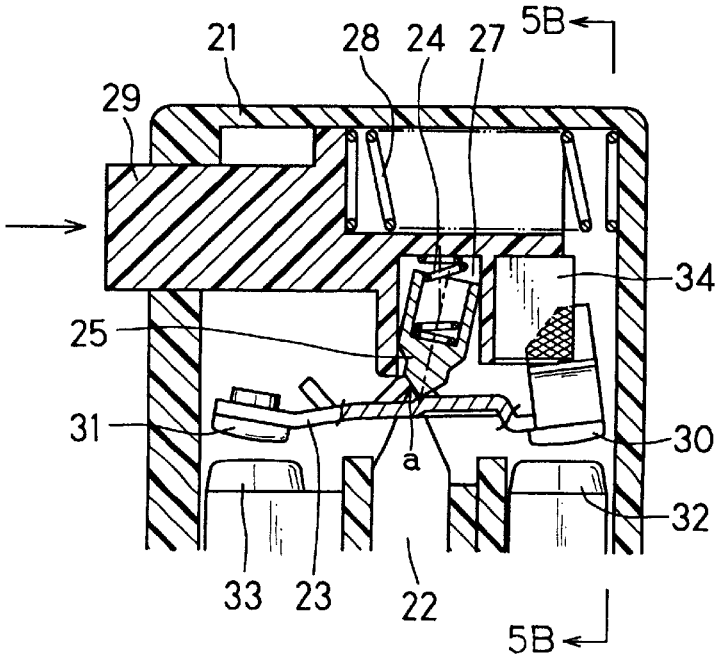
FIG. 5A is a longitudinal section of the switch.
Figure 5B:
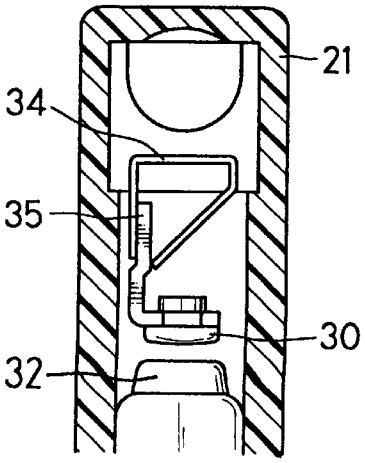
FIG. 5B is another longitudinal section taken along the line 5B—5B in FIG. 5A, illustrating how it works at the second step.
Figure 6A:
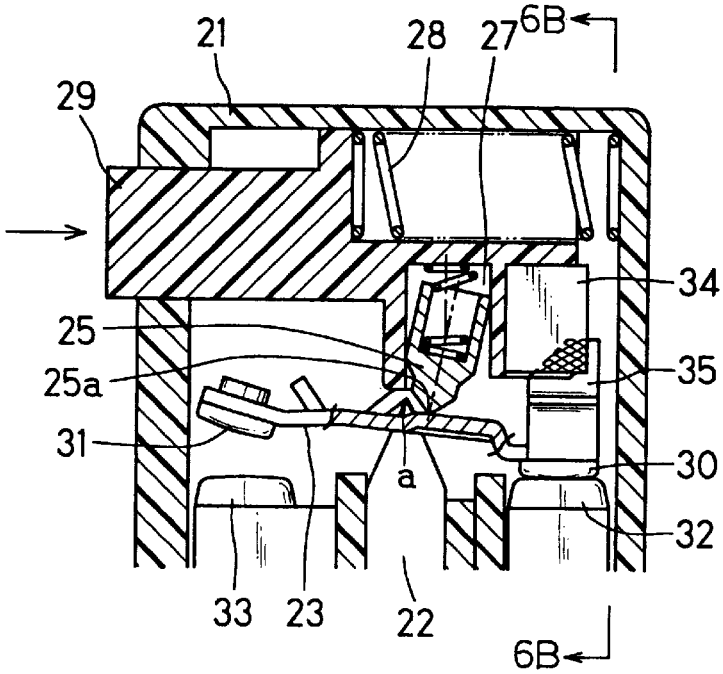
FIG. 6A is a longitudinal section of the switch.
Figure 6B:
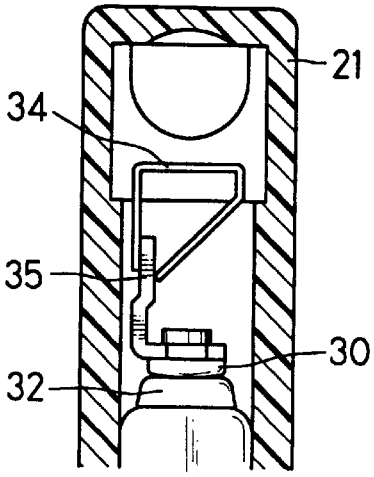
FIG. 6B is another longitudinal section taken along the line 6B—6B in FIG. 6A, illustrating how it works at the third step.

Referring to FIGS. 4 to 8, the manner in which the seesaw-like switch 20 works is described below. FIGS. 4 to 6 illustrate how the switch 20 turns on.

The actuator 29 is pushed against the inner wall of the housing 21 by the coiled spring 28. At the outset, the actuator 29 is depressed inward, allowing the resilient catch-and-hold piece 34 to catch and hold the engagement piece 35, the second upright section 35*b* of which is inserted into the throat 34*a*. In this position the movable contact 30 is raised above the stationary contact 32. The pusher 25 is tilted in the cylindrical space 27 of the actuator 29, so that the tapering end 25*a* of the pusher 25 may reach short of the fulcrum point "a". The tapering end 25*a* would traverse the fulcrum point "a" if the pusher 25 were not tilted leftward. Further depression of the actuator 29 makes the tapering end 25*a* traverse the fulcrum point "a", thus shortening the distance between the movable contact 30 and the stationary contact 32. In this position the converging end of the spring plate 34 pinches the "L"-shaped piece 35 to prevent the movable contact 30 from abutting on the stationary contact 32, as seen from FIG. 5.

Still further depression of the actuator 29 allows the movable contact 30 to abut on the stationary contact 32, as seen from FIG. 6. The "L"-shaped piece 35 remains to be caught and held by the converging end of the spring plate 34, allowing the movable contact 30 to move toward the stationary contact 32 slowly. As a consequence, the movable contact 30 is prevented from bouncing on the stationary contact 32. Thus, the retarded switching-on can be attained.

Figure 7A:
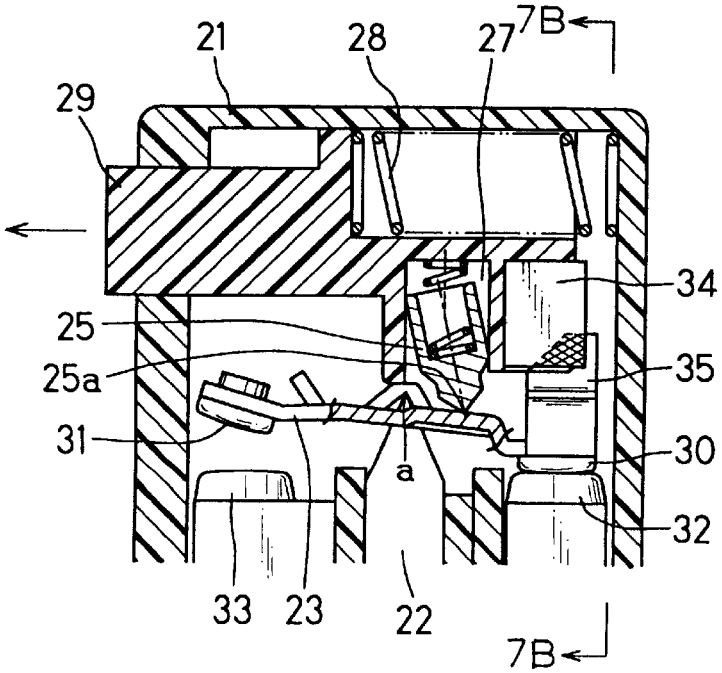
FIG. 7A is a longitudinal section of the switch.
Figure 7B:
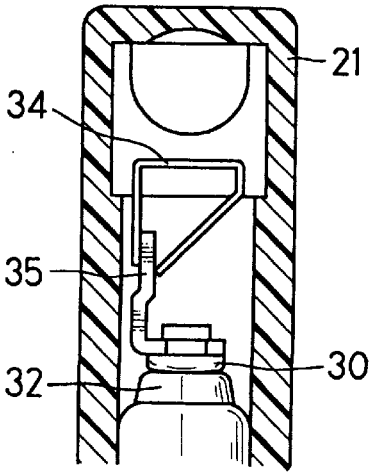
FIG. 7B is another longitudinal section taken along the line 7B—7B in FIG. 7A, illustrating how it works at the fourth step.
Figure 8A:
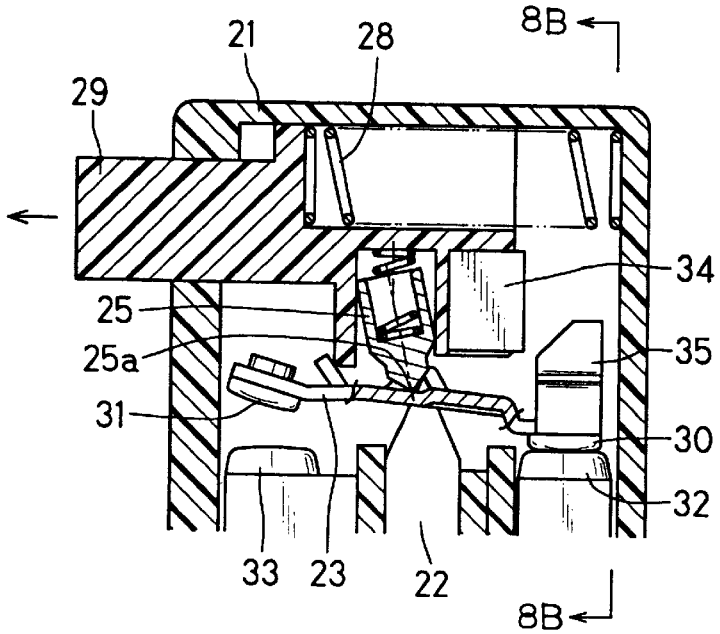
FIG. 8A is a longitudinal section of the switch.
Figure 8B:
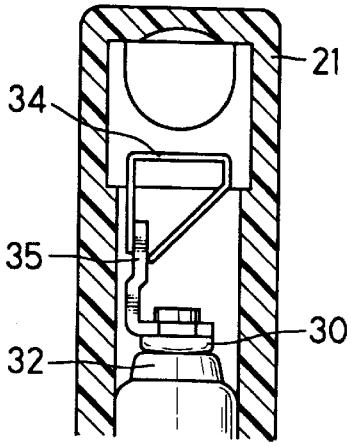
FIG. 8B is another longitudinal section taken along the line 8B—8B in FIG. 8A, illustrating how it works at the fifth step.

FIGS. 7 and 8 illustrate how the seesaw-like plate 23 can be displaced from the switching-on to switching-off position. The actuator 29 returns to the initial position when the hand is removed from the actuator 29.

Referring to FIG. 6, the movable contact 30 is put on the stationary contact 32 with the "L"-shaped engagement piece 35 caught and held by the spring plate 34. The seesaw-like plate 23 is pushed by the pusher 25, which is inclined rightward on the right side of the fulcrum point "a".

The actuator 29 is released to move leftward, allowing the pusher 25 to be inclined leftward, as seen from FIG. 8. After the catch-and-hold spring plate 34 releases the "L"-shaped engagement piece 35, the pusher 25 traverses the fulcrum point "a", and in the instant of sliding down on the ramp 37*a* (see FIG. 3) the movable contact 30 departs from the stationary contact 32 quickly.

Figure 9:
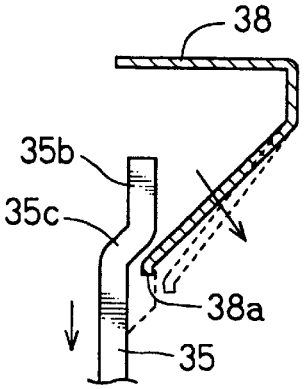
FIG. 9 illustrates another example of the anti-bounce means.

In this particular embodiment, the catch-and-hold piece is composed of an inverted "U"-shaped spring plate 34 (see FIG. 2). It may be an "L"-shaped spring plate 38, which can push the engagement piece 35 on one side, as seen from FIG. 9. The "L"-shaped spring plate 38 catches the engagement piece 35 with its end 38*a* applying resiliently to the bent section 35*c* of the engagement piece 35, as shown in solid lines. When the actuator 29 moves rearward, the end 38*a* of the "L"-shaped spring plate 38 is pushed apart from the bent section 35*c* of the engagement piece 35, as shown in broken lines.

Figure 10:
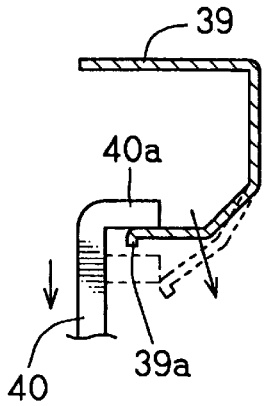
FIG. 10 illustrates still another example of the anti-bounce means.

Referring to FIG. 10, the catch-and-hold piece may be composed of a hook-shaped spring plate 39 whereas the engagement piece 40 may be so shaped as to have an inverted "L"-shaped end 40*a*. When the actuator 29 moves forward, the hook-shaped spring plate 39 catches the inverted "L"-shaped end 40*a* of the engagement piece 40, as shown in solid lines. When the actuator 29 moves backward, the hook-shaped spring plate 39 is yieldingly bent outward, allowing the inverted "L"-shaped end 40*a* to slip away from the hook-shaped spring plate 39, as shown in broken lines.

Figure 11:
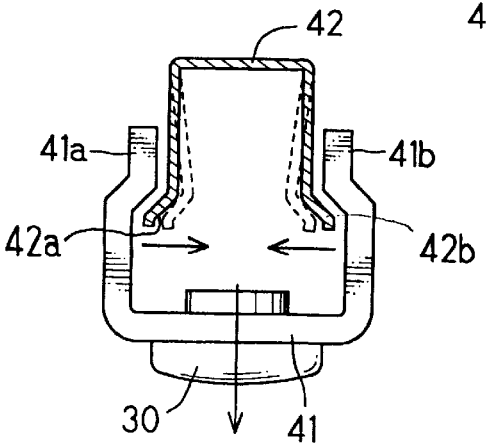
FIG. 11 illustrates still another example of the anti-bounce means.
Figure 12:
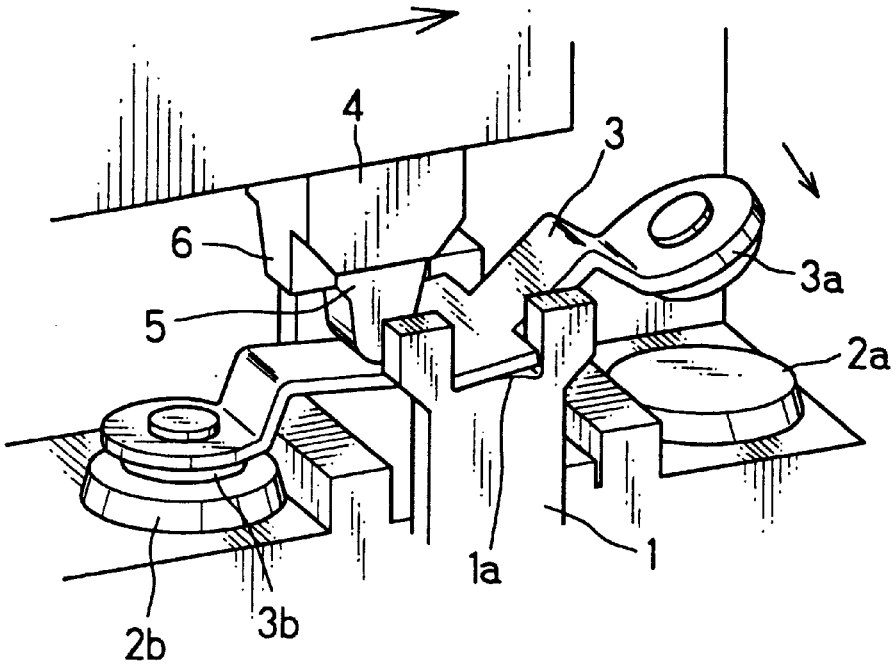
FIG. 12 PRIOR ART
FIG. 12 is a perspective view of a conventional seesaw type of switch.
Figure 13:
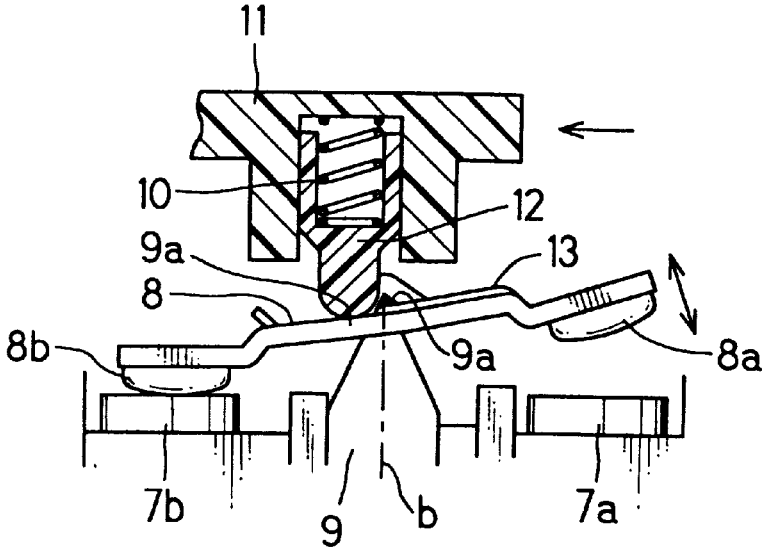
FIG. 13 PRIOR ART
FIG. 13 is a longitudinal section of another conventional fast switching-off type of direct current switch.

Referring to FIG. 11, the catch-and-hold piece may be composed of an inverted "U"-shaped piece 42, and the engagement piece may be composed of a "U"-shaped piece 41, which is so sized that the inverted "U"-shaped piece 42 may be snugly fitted in the "U"-shaped piece 41. When the actuator 29 moves forward, the inverted "U"-shaped piece 42 is snugly inserted in the "U"-shaped piece 41, as shown in solid lines. When the actuator 29 moves backward, the opposite bent legs 42*a* and 42*b* of the inverted "U"-shaped spring plate 42 are yieldingly bent inward (broken lines in FIG. 11), allowing the opposite bent legs of the "U"-shaped engagement piece 41 to slip away from the inverted "U"-shaped piece 42.

What is claimed is:

1. A direct current switch comprising a housing, an actuator slidably fixed to the housing, a support fixed to the housing, one stationary contact and one pseudo stationary contact both fixed to the housing, the stationary and pseudo stationary contacts being arranged symmetrically with respect to the support, a seesaw-like plate having one movable contact and one pseudo movable contact fixed to its opposite ends, the seesaw-like plate being supported by the support to be balanced in the middle, and a swingable pusher operatively connected to the actuator to apply a pushing force to the seesaw-like plate all the time, wherein the seesaw-like plate has an engagement piece fixed thereto in the vicinity of the movable contact, and that the actuator has a resilient catch-and-hold piece fixed thereto on the movable contact's side, whereby while the actuator is on the way to the end, the resilient catch-and-hold piece may catch and hold the engagement piece until the pusher makes the seesaw-like plate to be inclined toward the stationary contact, making the resilient catch-and-hold piece forcedly release the engagement piece, allowing the movable contact to quickly abut on the stationary contact.

2. A direct current switch according to claim 1, wherein the movable contact is allowed to move toward the stationary contact after the swingable pusher traverses the support.

3. A direct current switch according to claim 1, wherein the engagement piece comprises an "L"-shaped piece whose upright leg is bent so as to be caught by the catch-and-hold piece.

4. A direct current switch according to claim 1, wherein the catch-and-hold piece is of a spring plate.

5. A direct current switch according to claim 1 or 4, wherein the catch-and-hold piece comprises an inverted "U"-shaped piece to pinch the engagement piece.

6. A direct current switch according to claim 1 or 4, wherein the catch-and-hold piece is so shaped that it may push the engagement piece on one side.

7. A direct current switch according to claim 1, wherein the catch-and-hold piece comprises an inverted "U"-shaped piece, and the engagement piece comprises a "U"-shaped piece, which is sized so as to be snugly fitted in the inverted "U"-shaped piece.

8. A direct current switch according to claim 1, wherein the seesaw-like plate has a ramp formed in the vicinity of the fulcrum at which the support bears the seesaw-like plate, and the pusher and the actuator are so loosely connected that the pusher may be allowed to swing while pushing the seesaw-like plate.

* * * * *